US010774665B2

(12) United States Patent
Greene et al.

(10) Patent No.: US 10,774,665 B2
(45) Date of Patent: Sep. 15, 2020

(54) VERTICALLY ORIENTED SEAL SYSTEM FOR GAS TURBINE VANES

(71) Applicant: General Electric Company, Schenectady, NY (US)

(72) Inventors: John Ellington Greene, Greenville, SC (US); Neelesh Nandkumar Sarawate, Niskayuna, NY (US)

(73) Assignee: General Electric Company, Schenectady, NY (US)

( * ) Notice: Subject to any disclaimer, the term of this patent is extended or adjusted under 35 U.S.C. 154(b) by 114 days.

(21) Appl. No.: 16/050,008

(22) Filed: Jul. 31, 2018

(65) Prior Publication Data

US 2020/0040750 A1 Feb. 6, 2020

(51) Int. Cl.
*F01D 11/00* (2006.01)
*F01D 9/04* (2006.01)

(52) U.S. Cl.
CPC ..... *F01D 11/005* (2013.01); *F01D 9/042* (2013.01); *F05D 2220/32* (2013.01); *F05D 2240/12* (2013.01); *F05D 2240/55* (2013.01); *F05D 2240/80* (2013.01); *F05D 2300/5023* (2013.01); *F05D 2300/6033* (2013.01)

(58) Field of Classification Search
CPC ..... F01D 11/005; F01D 11/003; F01D 9/042; F01D 9/041; F01D 5/14; F05D 2240/55
See application file for complete search history.

(56) References Cited

U.S. PATENT DOCUMENTS

| | | | | |
|---|---|---|---|---|
| 6,375,415 | B1 * | 4/2002 | Burdgick | F01D 5/18 415/115 |
| 6,464,456 | B2 | 10/2002 | Darolia et al. | |
| 6,758,653 | B2 | 7/2004 | Morrison | |
| 7,052,234 | B2 * | 5/2006 | Wells | F01D 9/042 415/137 |
| 7,600,970 | B2 * | 10/2009 | Bhate | F01D 5/284 415/191 |
| 7,824,152 | B2 | 11/2010 | Morrison | |
| 8,096,758 | B2 | 1/2012 | Schiavo | |
| 8,206,098 | B2 * | 6/2012 | Prill | F01D 5/284 415/200 |
| 8,292,580 | B2 * | 10/2012 | Schiavo | F01D 5/189 416/229 A |
| 8,454,303 | B2 | 6/2013 | Garcia-Crespo | |
| 9,476,316 | B2 | 10/2016 | Hillier | |

(Continued)

*Primary Examiner* — Justin D Seabe
*Assistant Examiner* — Jackson N Gillenwaters
(74) *Attorney, Agent, or Firm* — Charlotte C. Wilson; James W. Pemrick

(57) ABSTRACT

A seal system for a gas turbine vane includes a first seal layer and an optional second seal layer. Each first seal layer includes multiple seal segments, each of which includes a first leg, a second leg, and an intermediate portion between the first leg and the second leg. Each adjacent pair of seal segments of the first seal is separated by a gap. The seal segments define a substantially complete perimeter of a seal slot in which the first seal is installed. The second seal, which is also segmented, may or may not define the substantially complete perimeter of the seal slot. If present, the second seal segments are circumferentially offset from the first seal segments to block the gaps between the first seal segments. A turbine vane including the present seal system is also disclosed.

11 Claims, 11 Drawing Sheets

(56) References Cited

U.S. PATENT DOCUMENTS

| | | | | |
|---|---|---|---|---|
| 9,951,640 | B2 | 4/2018 | Westphal et al. | |
| 10,487,943 | B2 * | 11/2019 | Davis | F16J 15/0887 |
| 2010/0072710 | A1 * | 3/2010 | Morgan | F01D 9/042 277/399 |
| 2017/0022833 | A1 * | 1/2017 | Heitman | F01D 25/243 |
| 2018/0030840 | A1 | 2/2018 | Freeman et al. | |
| 2018/0135453 | A1 * | 5/2018 | Propheter-Hinckley | F01D 5/12 |
| 2018/0163552 | A1 | 6/2018 | Reynolds et al. | |

* cited by examiner

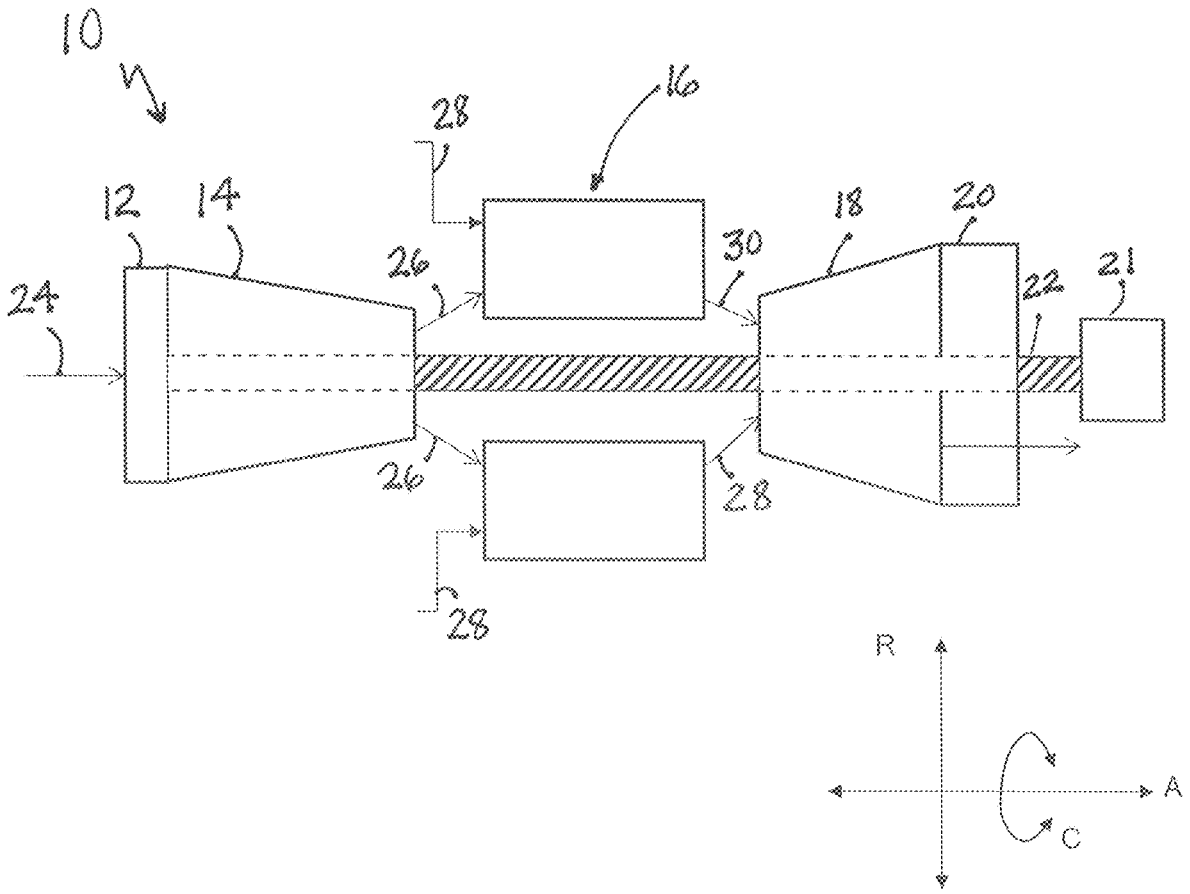
—FIG. 1—

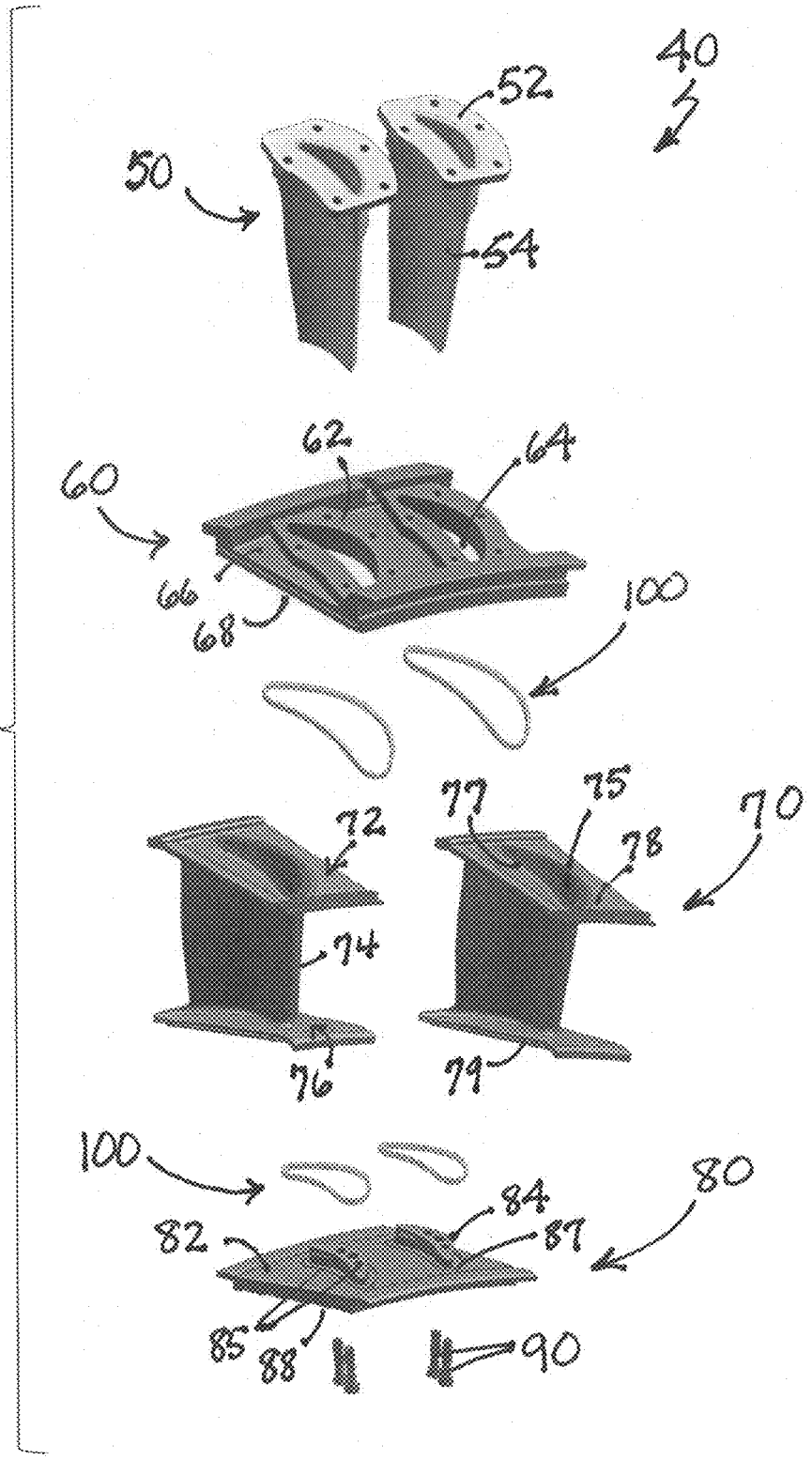
—FIG. 2—

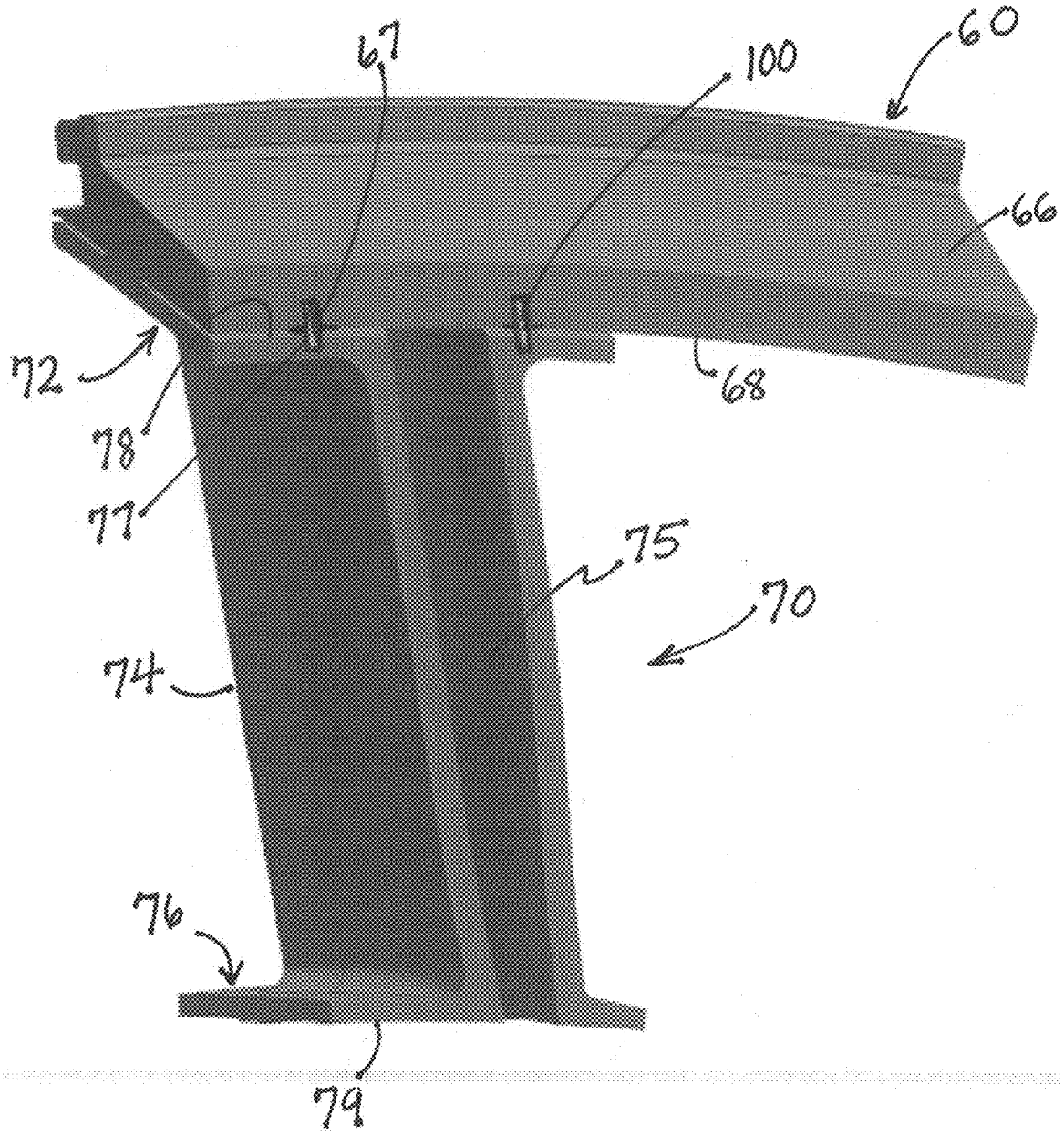
—FIG. 3—

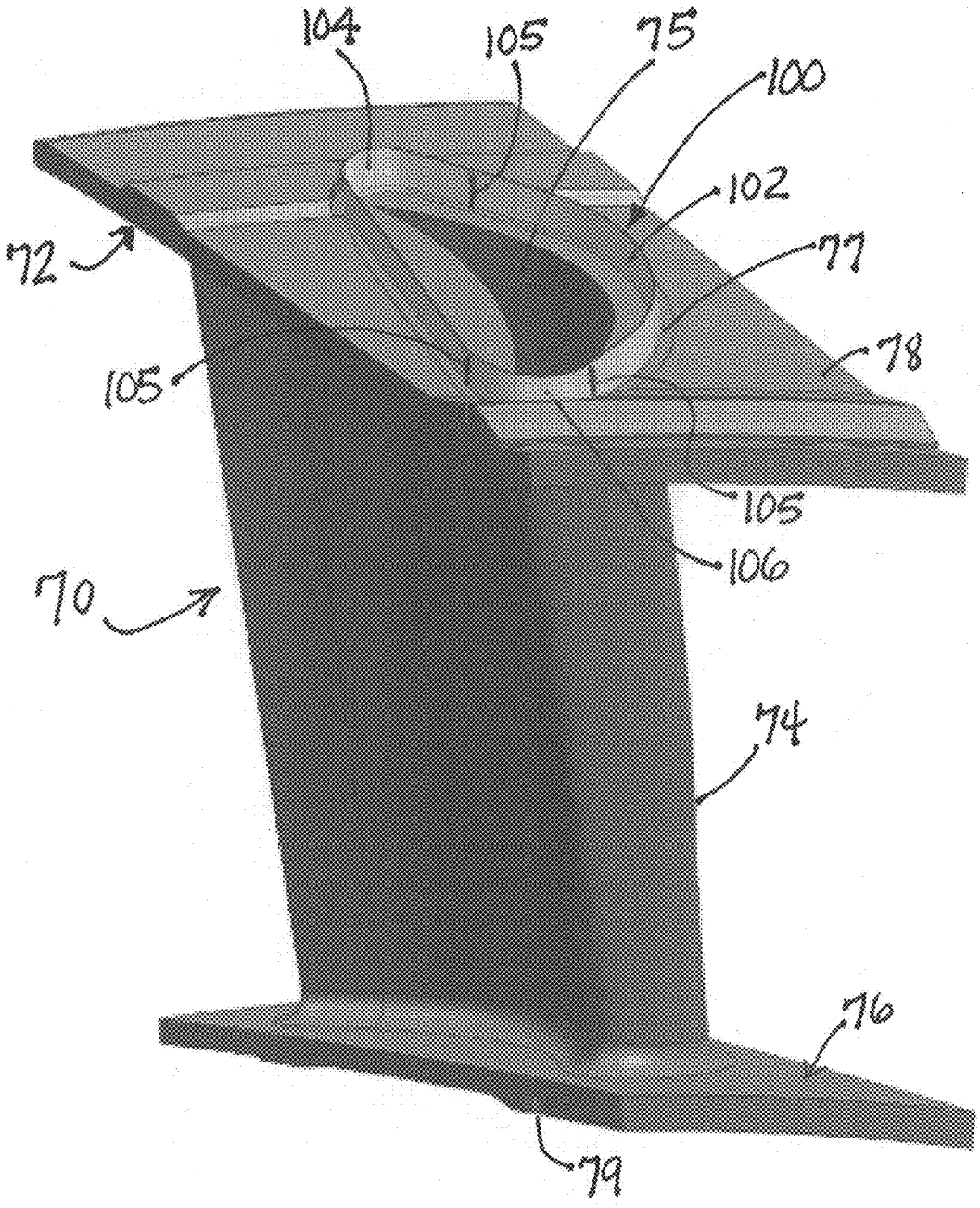
—FIG. 4—

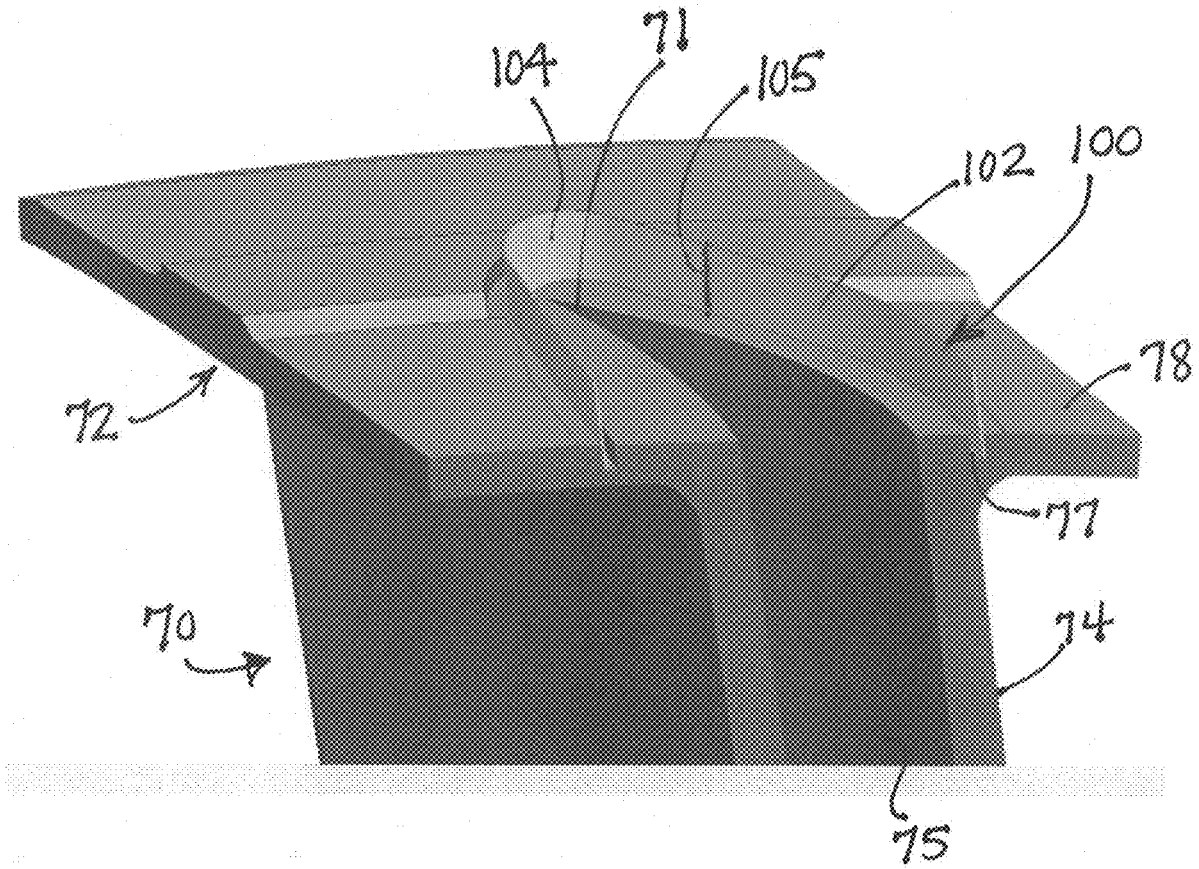
—FIG. 5—

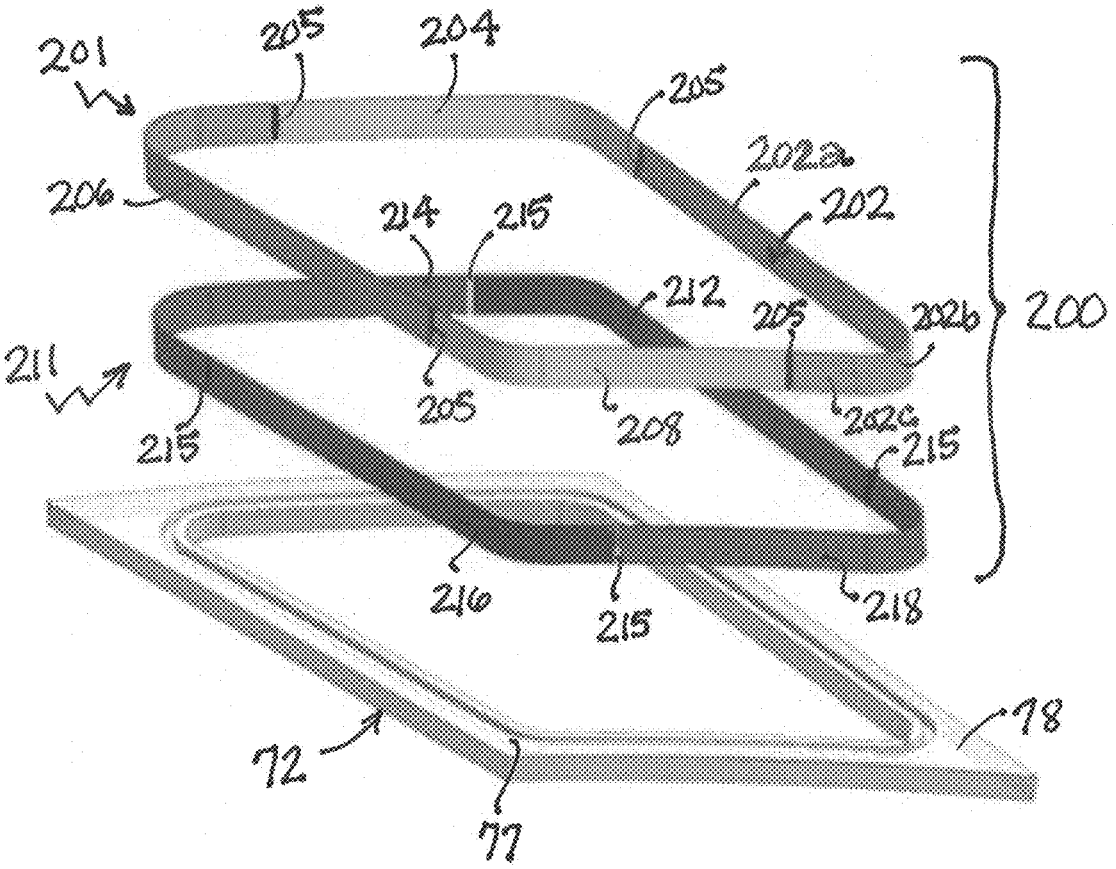
—FIG. 6—

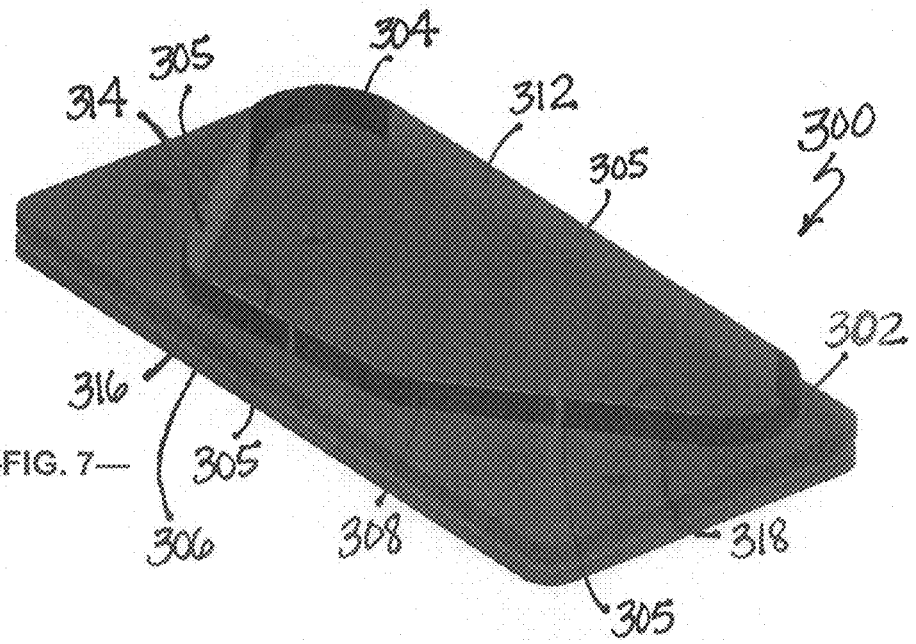
—FIG. 7—
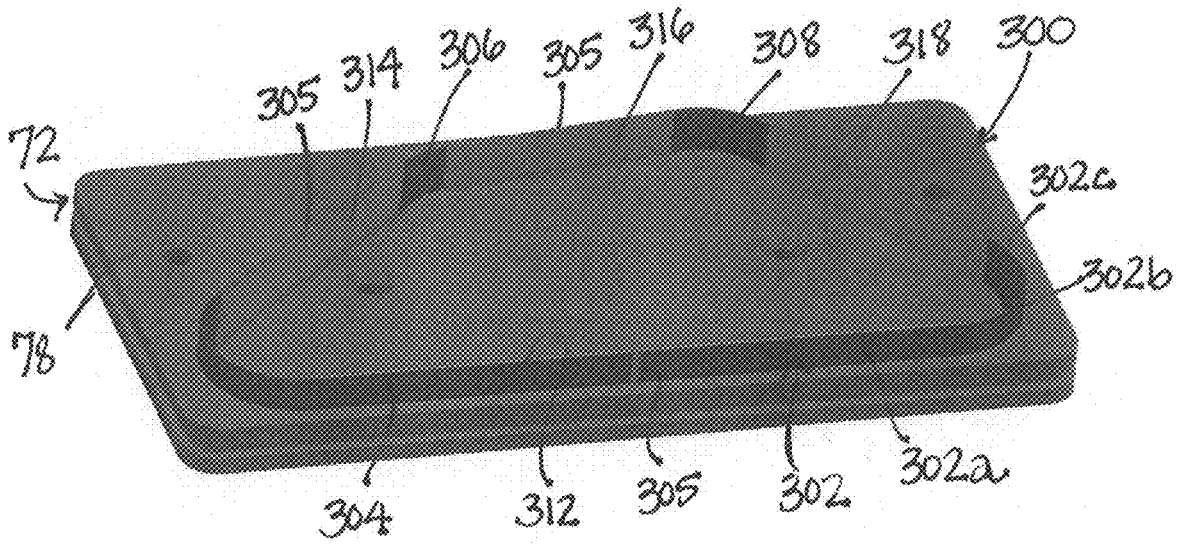
—FIG. 8—

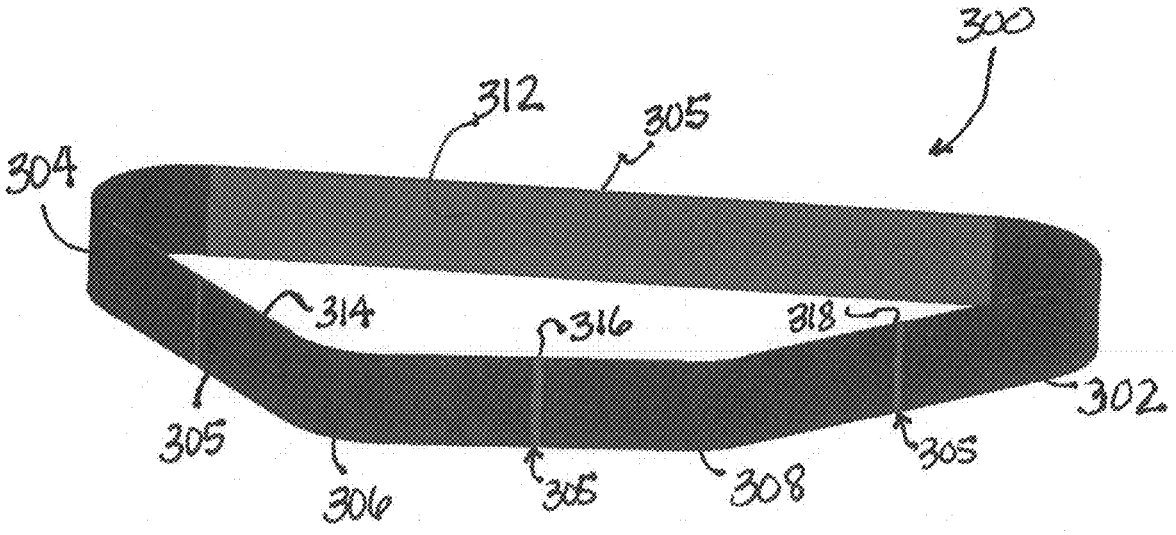
—FIG. 9—
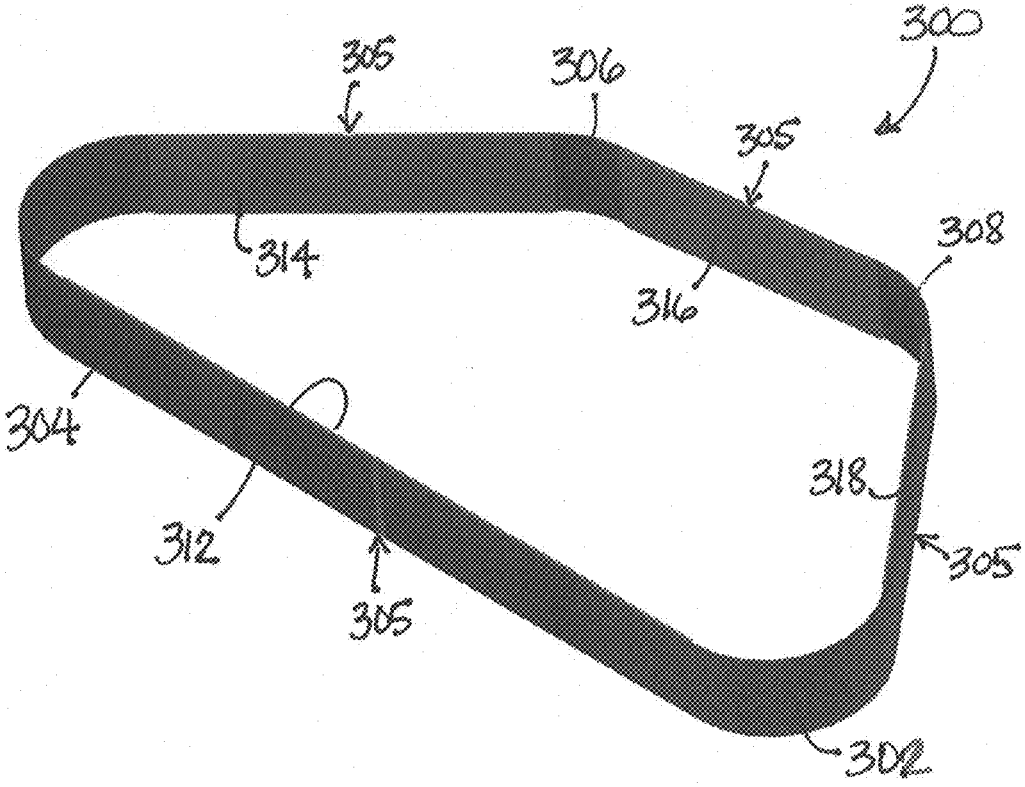
—FIG. 10—

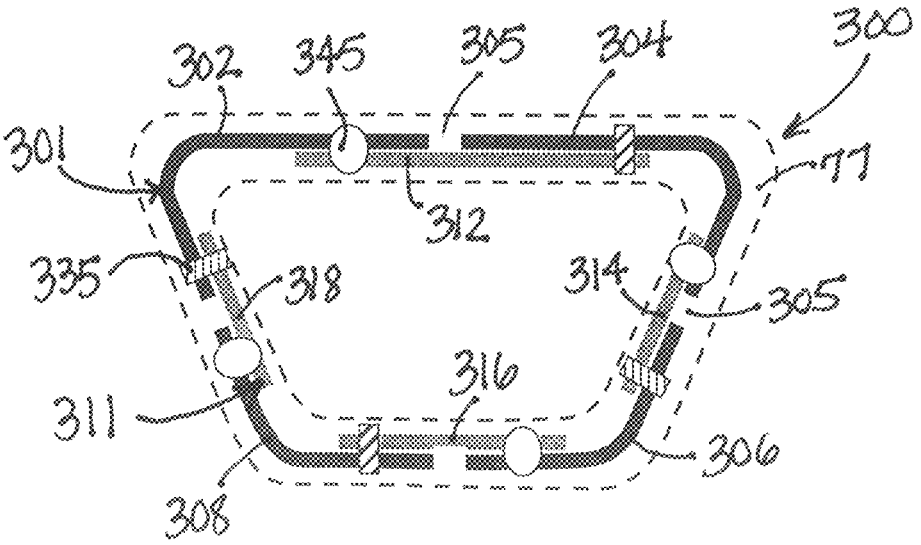
—FIG. 11—
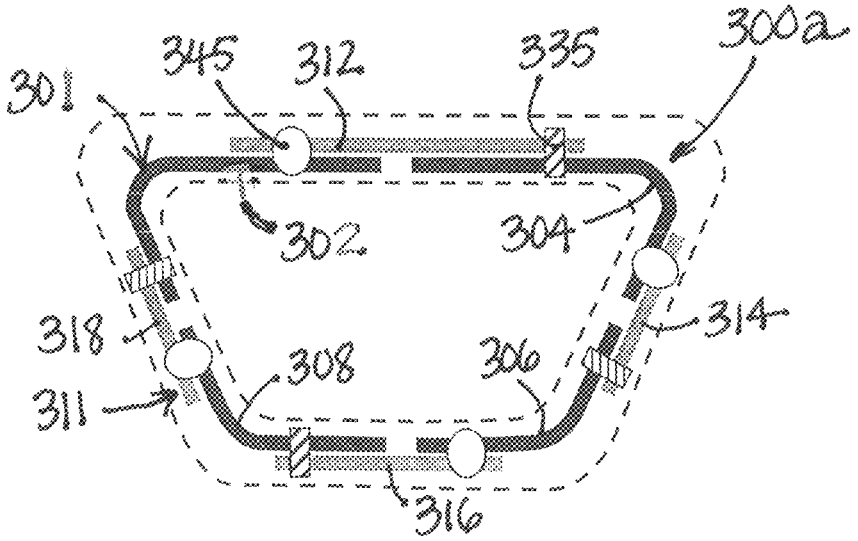
—FIG. 12—

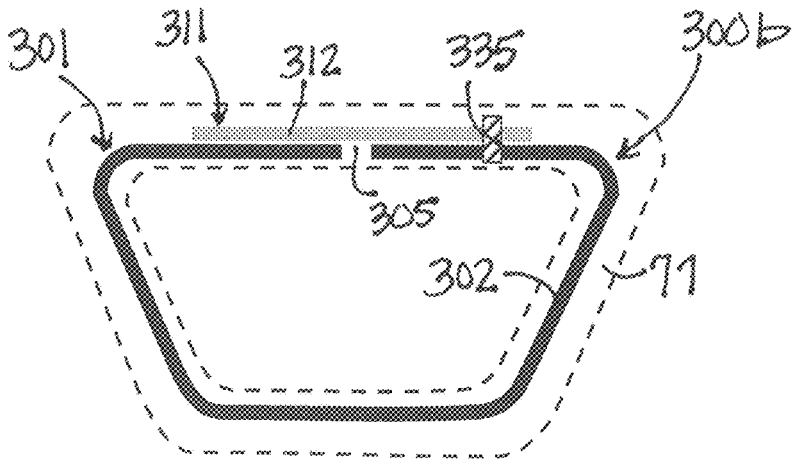
—FIG. 13—
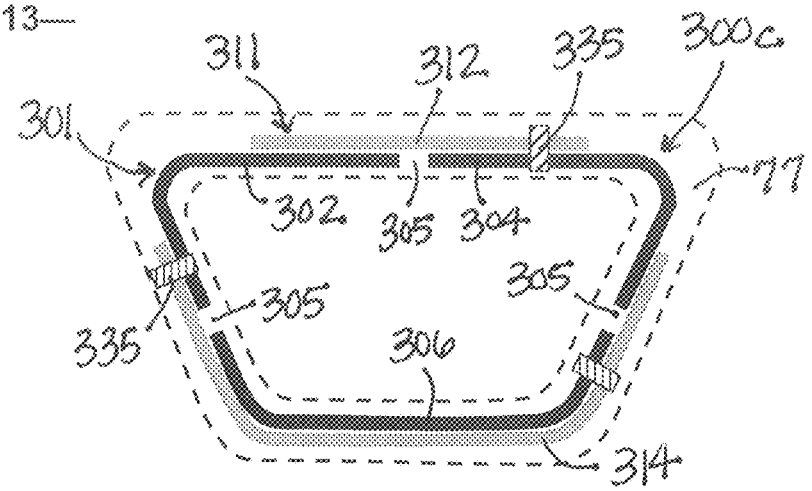
—FIG. 14—
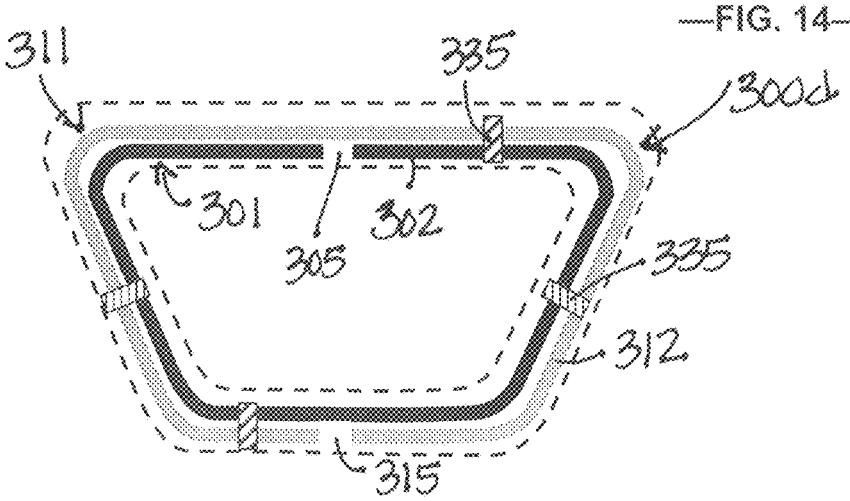
—FIG. 15—

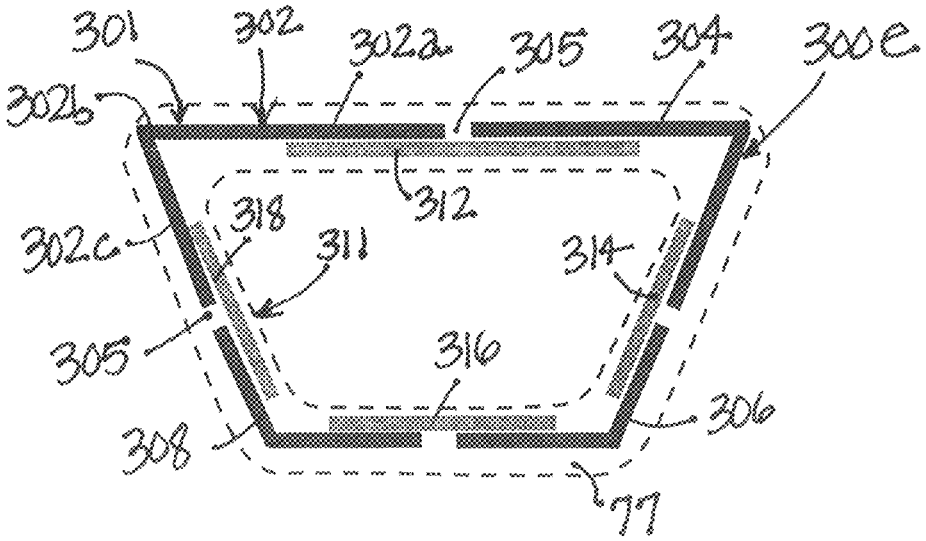
—FIG. 16—
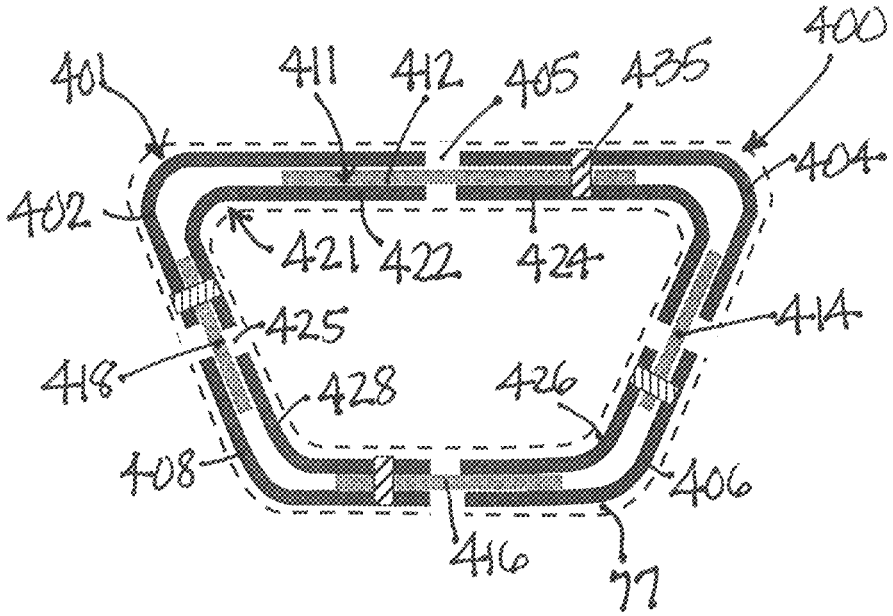
—FIG. 17—

VERTICALLY ORIENTED SEAL SYSTEM FOR GAS TURBINE VANES

STATEMENT REGARDING GOVERNMENT FUNDING

The subject matter of this disclosure was made with support from the United States government, under Contract Number DE-FE0024006, which was awarded by the U.S. Department of Energy. The government has certain rights in this invention.

TECHNICAL FIELD

The present disclosure relates generally to the field of gas turbines and, more particularly, to seals for gas turbine vanes that include a shell of a ceramic matrix composite (CMC) material disposed between metal side walls. The seals, which are vertically oriented, are disposed between a respective CMC shell and a metallic side wall.

BACKGROUND

Some conventional turbo machines, such as gas turbine systems, are utilized to generate electrical power. In general, gas turbine systems include a compressor, one or more combustors, and a turbine. Air may be drawn into a compressor, via its inlet, where the air is compressed by passing through multiple stages of rotating blades and stationary nozzles. The compressed air is directed to the one or more combustors, where fuel is introduced, and a fuel/air mixture is ignited and burned to form combustion products. The combustion products function as the operational fluid of the turbine.

The operational fluid then flows through a fluid flow path in a turbine, the flow path being defined between a plurality of rotating blades and a plurality of stationary nozzles disposed between the rotating blades, such that each set of rotating blades and each corresponding set of stationary nozzles defines a turbine stage. As the plurality of rotating blades rotate the rotor of the gas turbine system, a generator, coupled to the rotor, may generate power from the rotation of the rotor. The rotation of the turbine blades also causes rotation of the compressor blades, which are coupled to the rotor.

Gas turbine vanes are static components of the turbine section, which are configured to direct hot gases (at temperatures above 2,200° F.) in a hot gas path to the rotating portions of the turbine to achieve rotational motion of the rotor. Though significant advances in high temperature capabilities have been achieved, superalloy components must often be air-cooled and/or protected with a coating to exhibit a suitable service life in certain sections of the gas turbine engine, such as the airfoils. In order to withstand the high temperatures produced by combustion, the airfoils in the turbine section are cooled. Cooling the airfoils represents a parasitic loss to the power plant, since the air that is used to cool the parts has to be compressed but the amount of useful work that be extracted is comparatively small. As such, it is desirable to cool these parts with as low flow of air as possible to allow for efficient operation of the turbine.

The volume of cooling air required may be reduced by using more advanced materials, which can withstand the high temperature conditions in the hot gas flowpath. These materials, such as ceramic matrix composites (CMCs), can increase gas turbine efficiency because their properties reduce the cooling requirements for the respective parts.

One challenge in developing CMC vanes that efficiently use the available cooling air is sealing between the CMC vane shell and the respective inner and outer side walls that define therebetween the hot gas path. Often, such side walls are made of a metal alloy with different thermal properties than the CMC vane shell, making sealing between the disparate materials difficult. Leakage of the cooling fluids from the vanes can increase the parasitic losses to the turbine (thereby reducing its efficiency) and can increase the temperature of the vanes (thereby leading to increased stress and/or wear).

An effective sealing system is needed to address this problem.

SUMMARY

A seal system for a gas turbine vane includes a first seal layer and an optional second seal layer. Each first seal layer includes multiple seal segments, each of which includes a first leg, a second leg, and an intermediate portion between the first leg and the second leg. Each adjacent pair of seal segments of the first seal is separated by a gap. The seal segments define a substantially complete perimeter of a seal slot in which the first seal is installed. The second seal, which is also segmented, may or may not define the substantially complete perimeter of the seal slot. If present, the second seal segments are circumferentially offset from the first seal segments to block the gaps between the first seal segments. A turbine vane including the present seal system is also disclosed.

Specifically, according to one aspect provided herein, the seal system includes a first seal layer and a second seal layer. The first seal layer has one or more first gaps, and the second seal layer includes one or more second seal segments. The one or more second seal segments are positioned adjacent the first seal layer to block the one or more first gaps. The first seal layer and the second seal layer define a substantially complete perimeter of a seal slot in which the first seal layer and the second seal layer are vertically installed.

Specifically, according to another aspect provided herein, the seal system includes a first seal having a first plurality of seal segments. Each adjacent pair of seal segments of the first plurality of seal segments is separated by a first gap. The plurality of seal segments defines a substantially complete perimeter of a seal slot in which the first seal is vertically installed.

According to another aspect of the present disclosure, a turbine vane includes: a metal spar comprising an airfoil-shaped body; an outer side wall defining an opening through which the metal spar is installed; a ceramic matrix composite vane shell disposed over the airfoil-shaped body of the metal spar, the CMC vane shell having a radially outer vane platform and a radially inner vane platform; and an inner side wall joined to the ceramic matrix composite vane shell. A first seal system is disposed between the outer side wall and the radially outer vane platform, and a second seal system is disposed between the inner side wall and the radially inner vane platform. Each of the first seal system and the second seal system includes a plurality of seal segments vertically oriented within a respective platform seal slot and a respective side wall seal slot.

BRIEF DESCRIPTION OF THE DRAWINGS

The specification, directed to one of ordinary skill in the art, sets forth a full and enabling disclosure of the present system and method, including the best mode of using the same. The specification refers to the appended figures, in which:

FIG. 1 is a functional block diagram of an exemplary gas turbine that may incorporate various embodiments of the present disclosure;

FIG. 2 is an exploded view of a turbine vane, according to one aspect of the present disclosure;

FIG. 3 is a cross-sectional view of a portion of the turbine vane of FIG. 2, as assembled with an outer side wall, illustrating the present seal system between the outer side wall and a ceramic matrix composite shell;

FIG. 4 is an assembled turbine vane including a seal system, according to one aspect of the present disclosure;

FIG. 5 is a cross-sectional view of a portion of an assembled turbine vane of FIG. 3, illustrating a seal system, according to the present disclosure;

FIG. 6 is an exploded view of an alternate seal system as may be used with a turbine vane, according to an aspect of the present disclosure;

FIG. 7 is a perspective view of an alternate seal system as may be used with a turbine vane, according to another aspect of the present disclosure;

FIG. 8 is a perspective view of the alternate seal system of FIG. 7;

FIG. 9 is a perspective view of the seal system of FIG. 7;

FIG. 10 is a perspective view of the seal system of FIG. 7;

FIG. 11 is an overhead view of the seal system of FIG. 7, showing attachment locations between an inner seal layer and an outer seal layer;

FIG. 12 is an overhead view of an alternate view of the seal system of FIG. 7;

FIG. 13 is an overhead view of a seal system, according to another embodiment of the present disclosure;

FIG. 14 is an overhead view of a seal system, according to yet another embodiment of the present disclosure;

FIG. 15 is an overhead view of an alternate seal system, according to one aspect of the present disclosure;

FIG. 16 is an overhead view of yet another seal system, according to another aspect of the present disclosure; and FIG. 17 is an overhead view of another version of a seal system, according to another aspect of the present disclosure.

DETAILED DESCRIPTION

Reference will now be made in detail to various embodiments of the present disclosure, one or more examples of which are illustrated in the accompanying drawings. The detailed description uses numerical and letter designations to refer to features in the drawings. Like or similar designations in the drawings and description have been used to refer to like or similar parts of the disclosure.

To clearly describe the current seal system, certain terminology will be used to refer to and describe relevant machine components within the scope of this disclosure. To the extent possible, common industry terminology will be used and employed in a manner consistent with the accepted meaning of the terms. Unless otherwise stated, such terminology should be given a broad interpretation consistent with the context of the present application and the scope of the appended claims. Those of ordinary skill in the art will appreciate that often a particular component may be referred to using several different or overlapping terms. What may be described herein as being a single part may include and be referenced in another context as consisting of multiple components. Alternatively, what may be described herein as including multiple components may be referred to elsewhere as a single integrated part.

In addition, several descriptive terms may be used regularly herein, as described below. The terms "first", "second", and "third" may be used interchangeably to distinguish one component from another and are not intended to signify location or importance of the individual components.

As used herein, "downstream" and "upstream" are terms that indicate a direction relative to the flow of a fluid, such as the working fluid through the turbine engine. The term "downstream" corresponds to the direction of flow of the fluid, and the term "upstream" refers to the direction opposite to the flow (i.e., the direction from which the fluid flows). The terms "forward" and "aft," without any further specificity, refer to relative position, with "forward" being used to describe components or surfaces located toward the front (or compressor) end of the engine or toward the inlet end of the combustor, and "aft" being used to describe components located toward the rearward (or turbine) end of the engine or toward the outlet end of the combustor. The term "inner" is used to describe components in proximity to the turbine shaft, while the term "outer" is used to describe components distal to the turbine shaft.

It is often required to describe parts that are at differing radial, axial and/or circumferential positions. As shown in FIG. 1, the "A" axis represents an axial orientation. As used herein, the terms "axial" and/or "axially" refer to the relative position/direction of objects along axis A, which is substantially parallel with the axis of rotation of the gas turbine system. As further used herein, the terms "radial" and/or "radially" refer to the relative position or direction of objects along an axis "R", which intersects axis A at only one location. In some embodiments, axis R is substantially perpendicular to axis A. Finally, the term "circumferential" refers to movement or position around axis A (e.g., axis "C"). The term "circumferential" may refer to a dimension extending around a center of a respective object (e.g., a rotor).

The terminology used herein is for the purpose of describing particular embodiments only and is not intended to be limiting. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

Each example is provided by way of explanation, not limitation. In fact, it will be apparent to those skilled in the art that modifications and variations can be made without departing from the scope or spirit thereof. For instance, features illustrated or described as part of one embodiment may be used on another embodiment to yield a still further embodiment. Thus, it is intended that the present disclosure covers such modifications and variations as come within the scope of the appended claims and their equivalents.

Although exemplary embodiments of the present disclosure will be described generally in the context of sealing turbine nozzles for a land-based power-generating gas turbine for purposes of illustration, one of ordinary skill in the art will readily appreciate that embodiments of the present disclosure may be applied to other locations within a turbomachine and are not limited to turbine components for land-based power-generating gas turbines, unless specifically recited in the claims.

Referring now to the drawings, FIG. 1 schematically illustrates an exemplary gas turbine 10. The gas turbine 10 generally includes an inlet section 12, a compressor 14 disposed downstream of the inlet section 12, a combustion section 16 disposed downstream of the compressor 14, a turbine 18 disposed downstream of the combustion section 16, and an exhaust section 20 disposed downstream of the turbine 18. Additionally, the gas turbine 10 may include one or more shafts 22 (also known as "rotors") that couple the compressor 14 to the turbine 18.

During operation, air 24 flows through the inlet section 12 and into the compressor 14, where the air 24 is progressively compressed, thus providing compressed air 26 to the combustion section 16. At least a portion of the compressed air 26 is mixed with a fuel 28 within one or more combustors in the combustion section 16 and burned to produce combustion gases 30. The combustion gases 30 flow from the combustion section 16 to into the turbine 18, where thermal and/or kinetic energy are transferred from the combustion gases 30 to rotor blades (not shown) attached to the shaft 22, thereby causing the shaft 22 to rotate. The mechanical rotational energy may then be used for various purposes, such as to power the compressor 14 and/or to generate electricity, via a generator 21 coupled to the shaft 22. The combustion gases 30 exiting the turbine 18 may then be exhausted from the gas turbine 10, via the exhaust section 20.

Within the turbine 18, each row of rotor blades has a corresponding row of stationary vanes 40 that are positioned between and that are attached to an outer side wall 60 and an inner side wall 80. Collectively, the rotor blades and the adjacent stationary vanes define a turbine stage. Generally, the length of the rotor blades and stationary vanes increases with each stage, and many heavy-duty gas turbines 10 used for power generation have three or four turbine stages.

Gas turbines 10 are routinely operated at very high temperatures (e.g., with combustion gas temperatures in excess of 2,200° F., as the gases enter the turbine section 18). Such high temperatures require turbine blades and vanes to be cooled to prevent component stress or failure. The amount of air diverted to the turbine section 18 for cooling the blades and vanes 40 negatively impacts the efficiency of the gas turbine 10. Thus, to address the competing demands for power generation and high efficiency, some gas turbine manufacturers have contemplated using ceramic matrix composite (CMC) materials to create the blades and/or vanes of one or more turbine stages.

Two such turbine vanes 40 are shown in an exploded view in FIG. 2. Each turbine vane 40 includes a metal (e.g., superalloy) spar 50 that serves as the foundation of the vane 40. The metal spar 50 includes a mounting flange 52 and a hollow airfoil-shaped body 54 extending from the platform. The metal spar 50 is installed through an opening 64 in the outer side wall 60, which corresponds in size and shape to the airfoil-shaped body 54 of the metal spar 50. The opening 64 is surrounded by a mounting ledge 62 that projects radially outward from a platform 66 of the outer side wall 60. When the metal spar 50 is installed, the mounting flange 52 of the metal spar 50 is in contact with the mounting ledge 62.

One or more seal systems 100, according to various aspects of the present disclosure, are installed over the airfoil-shaped body 54 of the metal spar 50 and are positioned into a vertically oriented side wall seal slot 67 (see FIG. 3) on the radially inward surface 68 of the outer side wall 60. A CMC vane shell 70 is positioned over the airfoil-shaped body 54 of the metal spar 50. The CMC vane shell 70 includes an outer vane platform 72, an inner vane platform 76, and an airfoil-shaped body 74 extending radially between the inner vane platform 76 and the outer vane platform 72. The airfoil-shaped body 74 is hollow or substantially hollow to receive a flow of cooling air. A cavity 75, which corresponds in size and shape to the airfoil-shaped body 54 of the metal spar 50, extends through the airfoil-shaped body 74 from the outer vane platform 72 to the inner vane platform 76. The seal system 100 may be positioned within a vertically oriented platform seal slot 77 on a radially outward surface 78 of the outer vane platform 72. The platform seal slot 77 is aligned with the side wall seal slot 67, so that the seal 100 is oriented vertically, or upright, within the seal slots 67, 77.

The seal system 100 has one or more layers, and each layer has one or more seal segments. According to one aspect of the present disclosure, the seal system 100 is installed within a corresponding vertically oriented platform seal slot (not shown) on a radially inward surface 79 of the inner vane platform 76 before the CMC vane shell 70 is brought into contact with the inner side wall 80. The inner side wall 80 includes a platform 82 and an airfoil-shaped extension 84 that projects radially outward from the platform 82. The airfoil-shaped extension 84 is sized and shaped to fit within the cavity 75 in the CMC vane shell 70. A vertically oriented side wall seal slot 87 is formed around the airfoil-shaped extension 84 in the platform 82 to engage the one or more seal layers and/or segments of the seal system 100. Bolts 90, threaded from the radially inward surface 88 of the platform 82 through bolt holes 85, secure the inner side wall 80 to the CMC vane shell 70.

FIG. 3 shows a cross-sectional view of a portion of the vane 40, in which only the CMC vane shell 70 and the outer side wall 60 are illustrated. (That is, the metal spar 50 and the inner side wall 80 are not shown.) One or more seal layers and/or segments of the seal system 100 are disposed within the respective vertically oriented seal slots 67, 77 on the radially inward surface 68 of the outer side wall 60 and the radially outward surface 78 of the outer vane platform 72. The seal system 100 is disposed in a generally vertical orientation (i.e., parallel to a centerline axis of the vane 40).

FIG. 4 illustrates a perspective view of the CMC vane shell 70 and the seal system 100, in which the outer side wall 60 is removed to provide a view of the entire seal system 100. The seal system 100, which is oriented vertically within the side wall seal slot 77, includes a first seal segment 102, a second seal segment 104, and a third seal segment 106. A small gap 105 is formed between each pair of adjacent seal segments 102/104, 104/106, 106/102. Although the seal segments 102, 104, and 106 are the same height, the seal segments 102, 104, and 106 may be of different lengths. In the exemplary embodiment shown in FIGS. 2 through 5, the seal system 100 has a generally airfoil-shaped profile, and the seal segments 102, 104, 106 are curved to define the substantial perimeter of this profile.

As shown herein, the platform seal slot 77 and the seal segments 102, 104, 106 are perpendicular to the radially outward surface 78 of the outer vane platform 72. However, the seal slot 77 may be angled, relative to a longitudinal axis of the vane 40, thereby causing the seal segments 102, 104, 106 to be angled as well. In this instance (not shown), the side wall seal slot 67 of the outer side wall 60 is offset radially to accommodate the angle of the platform seal slot 77 and the height of the seal segments 102, 104, 106.

FIG. 5 provides an enlarged cross-sectional view of the CMC vane shell 70 and the seal system 100, as shown in FIG. 4. The airfoil-shaped cavity 75 has a curved leading edge (visible in FIG. 2) and an opposite trailing edge 71. The platform seal slot 77 is disposed radially outward of the perimeter of the cavity 75 and defines a shape conforming generally to the cross-sectional shape of the cavity 75. Rather than positioning the gap 105 between seal segments 102, 104 at the area of the platform seal slot 77 with the smallest radius, the present seal system 100 disposes the gap 105 at a circumferentially offset position from the trailing edge 71. Likewise, as shown in FIG. 4, the third seal segment 106 has an arcuate profile that spans the leading edge, such that the gaps 105 between the third seal segment 106 and the adjacent seal segments 102, 104 are offset from the leading edge. This configuration minimizes leakage that may otherwise occur at areas with a small radius.

While FIGS. 2 through 5 illustrate the seal segments 102, 104, 106 as being installed between the radially outward surface 78 of the outer vane platform 72 and the outer side wall 60, it should be appreciated that a corresponding seal system 100 having seal segments 102, 104, 106 is used to seal between the radially inward surface 79 of the inner vane platform 76 and the inner side wall 80.

The seal segments 102, 104, 106, as illustrated, are thin strips or ribbons of sheet metal or metal cloth, which may or may not be coated or sealed. The seal segments 102, 104, 106 are flexible enough (in the longitudinal direction) to permit insertion into the respective seal slots 67, 77, 87, but are rigid enough (in the transverse direction) to retain their upright position in the seal slots 67, 77, 87. The seal segments 102, 104, 106, as positioned between respective seal slots 67, 87 in the side walls 60, 80 and the seal slots 77 in the CMC vane shell 70, are secured in position, minimizing the likelihood of creep during operation of the turbine. The seal segments 102, 104, 106 may be a single layer, as shown, or may be multiple layers as shown in FIGS. 6 through 10.

In FIG. 6, a seal system 200 is illustrated, which includes a first seal layer 201 and a second seal layer 211. For purposes of illustration only, the seal layers 201 and 211 are shown as having a generally rectangular shape, although clearly the principles described apply equally to seal systems of other shapes (including the airfoil shape of FIGS. 2 through 5 and the trapezoidal shape of FIGS. 7 through 17).

The first seal layer 201 includes a first seal segment 202, a second seal segment 204, a third seal segment 206, and a fourth seal segment 208, each of the first seal segments being separated by a gap 205. The second seal layer 211 includes a fifth seal segment 212, a sixth seal segment 214, a seventh seal segment 216, and an eighth seal segment 218, each of the second seal segments being separated by a gap 215. Each of the seal segments 202-218 is configured with a generally J- or L-shaped profile, having one long leg (e.g., 202*a*) and one short leg (e.g., 202*c*) and defining an intermediate portion (e.g., 202*b*) between the long leg and the short leg. As illustrated, the intermediate portion (e.g., 202*b*) may be a curved portion having a radius of curvature that creates an angle of approximately 90-degrees between the long leg and the short leg.

In one embodiment, each seal segment 202-218 is of the same size (height, length, and thickness) and, therefore, is interchangeable with any other seal segment 202-218. Alternately, all the seal segments 202-218 may have the same height, but at least some of the seal segments 202-218 be made in different lengths. In another embodiment, the seal segments 202, 204, 206, 208 may have a first height, and the seal segments 212, 214, 216, 218 may have a second height different from the first height.

The second seal layer 211 is sized to nest within the first seal layer 201 (or vice versa). Further, it should be noted that the seal segments 212, 214, 216, 218 of the second seal layer 211 are circumferentially offset from the seal segments 202, 204, 206, 208 of the first seal layer 201, such that the gaps 205, 215 between the seal segments 202-208 and 212-218 are blocked by a respective seal segment of the radially adjacent seal layer 211, 201. This configuration helps to minimize leakage by creating more blockages for air trying to escape the cavity 75 of the vane 40.

The seal layers 201, 211 of the seal system 200 are installed in an upright position in a platform seal slot (e.g., slot 77) in the radially outward surface 78 of the outer vane platform 72. The same seal system 200 may be used in a respective platform seal slot (not shown) in the radially inward surface 79 of the inner vane platform 76.

FIGS. 7 through 10 refer to a seal system 300, according to another aspect of the present disclosure. For the sake of illustration, the seal system 300 is shown installed on the radially outward surface 78 of the outer vane platform 72, although the seal system 300 is equally applicable for use on the respective platform seal slot (not shown) in the radially inward surface 79 of the inner vane platform 76. In this exemplary embodiment, the seal system 300 defines the general shape of a trapezoid, although the seal system 300 is applicable to other shapes.

The seal system 300 includes a first layer of seal segments 302, 304, 306, 308 that fill substantially all the perimeter of the platform seal slot 77 (excluding gaps 305) in the radially outward surface 78 of the outer vane platform 72. As used herein the phrase "substantially complete" means that the perimeter of the respective seal slot (e.g., 77) is filled except for the small area defining the gaps (e.g., 305). Gaps 305 are defined between adjacent seal segments 302/304, 304/306, 306/308, 308/302. The gaps 305 may or may not be of uniform width. Each seal segment 302, 304, 306, 308 has a first leg (e.g., 302*a*) and a second leg (e.g., 302*c*) and define an intermediate portion (e.g., 302*b*) between the first leg and the second leg. In the exemplary embodiment, the intermediate portion (e.g., 302*b*) has a radius of curvature that is greater than or less than 90 degrees.

In an exemplary embodiment, the first seal segment 302 and the second seal segment 304 have the same dimensions and are mirror images of one another, while the third seal segment 306 and the fourth seal segment 308 have the same dimensions and are mirror images of one another. There is no requirement that seal segments 302, 304, 306, 308 have any particular size relative to one another, provided that the seal segments 302, 304, 306, 308 have a uniform height and include an intermediate portion connecting the respective legs of the seal segment.

A second layer of seal segments 312, 314, 316, 318 is disposed radially inward of the first layer of seal segments 302, 304, 306, 308. Each seal segment 312, 314, 316, 318 is a straight seal segment having a height matching the height of the first layer of seal segments 302, 304, 306, 308. Each straight seal segment 312, 314, 316, 318 is positioned to block a respective gap 305 between adjacent seal segments 302/304, 304/306, 306/308, 308/302.

Specifically, the fifth seal segment 312 is positioned radially inward of the first seal segment 302 and the second seal segment 304 to block the gap 305 between the first and second seal segments 302, 304. The sixth seal segment 314 is positioned radially inward of the second seal segment 304 and the third seal segment 306 to block the gap 305 between the second and third seal segments 304, 306. The seventh seal segment 316 is positioned radially inward of the third seal segment 306 and the fourth seal segment 308 to block the gap 305 between the third and fourth seal segments 306, 308. The eighth seal segment 318 is positioned radially inward of the fourth seal segment 308 and the first seal segment 302 to block the gap 305 between the fourth and first seal segments 308, 302.

In the exemplary embodiment in which the seal system 300 defines a trapezoidal shape, the sixth seal segment 314 and the eighth seal segment 318 have the same length, and the seventh seal segment 316 is shorter than the fifth seal segment 312. Thus, the sixth and eighth seal segments 314, 316 are interchangeable with one another, and the lengths of the fifth and seventh seal segments 312, 316 ensure their proper placement within the platform seal slot 77.

FIGS. 11 through 16 illustrate various embodiments of the seal system 300 having a first seal layer 301 of one or more seal segments (represented by black lines) and a second seal layer 311 of one or more seal segments (represented by gray lines). The seal segments are vertically oriented in a seal slot 77 (represented by dashed lines). Gaps in the first seal layer 301 are blocked by a respective seal segment of the second seal layer 311. The second seal layer 311 may be radially inward of the first seal layer 301 (as shown in FIGS. 11 and 16) or may be radially outward of the first seal layer 301 (as shown in FIGS. 12 through 15).

In FIG. 11, the first seal layer 301 is disposed radially outward of the second seal layer 311. The first seal layer 301 defines a substantially complete perimeter of the seal slot 77, which is complete except for the first gaps 305 between the first seal segments 302, 304, 306, 308.

Each of the first seal segments 302, 304, 306, 308 has a generally J- or L-shape with a long leg, a short leg, and an intermediate portion between the long leg and the short leg. Each of the second seal segments 312, 314, 316, 318 is a straight seal. The straight seal segments 312, 314, 316, 318 are disposed in contact with the first seal segments 302, 304, 306, 308, in such a location as to block the gaps 305 between each pair of adjacent first seal segments 302/304, 304/306, 306/308, 308/302.

The number of first seal segments 302, 304, 306, 308 in the first seal layer 301 is equal to the number of seal segments 312, 314, 316, 318 in the second seal layer 311. Although four seal segments are used in each seal layer 301, 311 in the embodiment of FIG. 11, other numbers of seal segments may instead be used.

To simplify installation of the seal layers 301, 311, each first seal segment (e.g., 302) may be permanently coupled to a radially adjacent second seal segment (e.g., 318). The coupling 335, which is represented by a rectangle, may be one of a spot weld, a rosette weld, a braze joint, or a flat-headed rivet. By permanently coupling each first seal segment to a radially adjacent second seal segment, the number of units to be installed in the slot 77 is divided in half.

Optionally, each first seal segment (e.g., 302) may be temporarily coupled to a second seal segment (e.g., 312) that is circumferentially adjacent to the second seal segment (e.g., 318) to which the permanent coupling 335 is made. The temporary coupling 345, which is represented by an oval, may be one of an adhesive that is non-durable under the operating temperatures of the gas turbine 10 or a removable fastener, such as tape or a binder clip. The temporary coupling 345 is used to hold all the seal segments 302-318 as a single unit to facilitate installation into the seal slot 77. If a removable fastener is used as the temporary coupling 345, the removable fastener may be removed after the seal system 300 is positioned within the seal slot 77.

In the seal system 300*a* of FIG. 12, the first seal layer 301 is disposed radially inward of the second seal layer 311. As in FIG. 11, the first seal layer 301 defines a substantially complete perimeter of the seal slot 77, which is complete except for the first gaps 305 between the first seal segments 302, 304, 306, 308. The number of first seal segments 302, 304, 306, 308 in the first seal layer 301 is equal to the number of seal segments 312, 314, 316, 318 in the second seal layer 311. Although four seal segments are used in each seal layer 301, 311, other numbers of seal segments may instead be used.

As described above, the seal segments 302, 304, 306, 308 may be permanently coupled to radially adjacent seal segments 318, 312, 314, 316, respectively, as represented by permanent coupling joints 335. Optionally, the seal segments 302, 304, 306, 308 may be temporarily coupled, via dissolvable or removable fasteners 345, to seal segments 312, 314, 316, 318 that are circumferentially adjacent to the seal segments 318, 312, 314, 316 with the permanent coupling.

FIG. 13 illustrates an exemplary seal system 300*b*, in which the first seal layer 301 includes a single seal segment 302, and the second seal layer 311 includes a single seal segment 312. The first seal segment 302 fills a substantially complete perimeter of the seal slot 77, excluding the gap 305. The straight second seal segment 312 is positioned radially outward of the first seal segment 302 and is located to block the gap 305. The first seal layer 301 and the second seal layer 311 may be permanently coupled, via coupling 335.

In the illustrated embodiment, the gap 305 is located along the portion of the seal segment 302 with the longest length, although the gap 305 may be located instead along any other portion of the seal segment 302. It should be understood that the second seal segment 312 is positioned along any portion of the seal segment 302 where the gap 305 is located.

FIG. 14 illustrates an exemplary seal system 300*c*, in which the number of seal segments in the first seal layer 301 is different from the number of seal segments in the second seal layer 311. The first seal layer 301 includes three seal segments 302, 304, 306, and the second seal layer 311 includes two seal segments 312, 314 that are positioned radially outward of the first seal layer 301. The seal segments 302, 304, 306 of the first seal layer 301 are spaced to define gaps 305 between the seal segments 302, 304, 306, and the seal segments 312, 314 are positioned to block these gaps 305.

In the illustrated embodiment, the second seal segment 314 blocks the gaps 305 between seal segments 304/306 and 306/302, while the seal segment 312 blocks the gap 305 between first seal segments 302, 304. The seal segments 312, 314 of the second seal segment 311 may be permanently coupled to the seal segments 302, 304, 306, via permanent couplings 335.

FIG. 15 illustrates an exemplary seal system 300*d*, in which the first seal layer 301 is a single seal segment 302, and the second seal layer 311 is a single seal segment 312 disposed radially outward of the first seal layer 301. The seal segment 302 defines the gap 305, and the seal segment 312 defines the gap 315, which is circumferentially offset from the gap 305. The gaps 305, 315 may be disposed in any location along the respective seal segment 302, 312, as long as the gaps 305, 315 do not align circumferentially with one another.

FIG. 16 illustrates an exemplary seal system 300*e*, in which the first seal layer 301 includes seal segments 302, 304, 306, 308 that each include a first leg (e.g., 302*a*), a second leg (e.g., 302*c*), and an intermediate portion 302*b*, in the form of an angular corner. In the illustrated embodiment, the second seal layer 311 (including seal segments 312, 314, 316, 318) is disposed radially inward of the first seal layer 301, although the opposite configuration may instead be used. As before, the seal segments 312, 314, 316, 318 are positioned to block the gaps 305 between circumferentially adjacent seal segments 302/304, 304/306, 306/308, 308/302. The segments 302-308 of the first seal layer 301 may be coupled to the radially adjacent segments 312-318 of the second seal layer 311, via permanent couplings 335 and/or temporary couplings 345 (neither of which are shown in this illustration).

FIG. 17 illustrates a seal system 400 having a first seal layer 401, a second seal layer 411, and a third seal layer 421. The first seal layer 401 includes seal segments 402, 404, 406, 408 with gaps 405 being defined between circumferentially adjacent pairs of seal segments. Each seal segment 402, 404, 406, 408 generally has a dog-leg shape having a first leg (e.g., 402*a*), a second leg (e.g., 402*c*), and an intermediate portion (e.g., 402*b*) connecting the first leg to the second leg. The intermediate portion may be curved (as shown) or may define an angular corner (as in FIG. 16).

The second seal layer 411 includes seal segments 412, 414, 416, 418, which are straight seal segments positioned to block the gaps 405 defined between the respective pairs of seal segments 402/404, 404/406, 406/408, 408/402.

The third seal layer 421 includes seal segments 422, 424, 426, 418, which may or may not have the same shape as the seal segments 402, 404, 406, 408 of the first seal layer 401. As shown, each of the seal segments 422, 424, 426, 428 generally have a dog-leg shape, and gaps 425 are defined between each pair of seal segments. It is not necessary that the gaps 425 align with the gaps 405. Rather, the second seal segments 412, 414, 416, 418 are positioned to simultaneously block the gaps 405 in the first seal layer 401 and the gaps 425 in the third seal layer 421.

The seal layers 401, 411, 421 may be coupled together by permanent couplings 435, as shown, to simplify installation.

Exemplary embodiments of the seal system and methods of installing the same are described above in detail. The methods and seals described herein are not limited to the specific embodiments described herein, but rather, components of the methods and seals may be utilized independently and separately from other components described herein. For example, the methods and seals described herein may have other applications not limited to practice with turbine nozzles for power-generating gas turbines, as described herein. Rather, the methods and seals described herein can be implemented and utilized in various other industries.

While the technical advancements have been described in terms of various specific embodiments, those skilled in the art will recognize that the technical advancements can be practiced with modification within the spirit and scope of the claims.

What is claimed is:

1. A seal system comprising:

a first seal layer comprising a plurality of first seal segments, wherein respective first gaps are defined between each respective pair of first seal segments, each first seal segment of the plurality of first seal segments comprising a first leg, a second leg, and an intermediate portion connecting the first leg to the second leg; and a second seal layer comprising a plurality of second seal segments equal in number to the plurality of first seal segments, the plurality of second seal segments being positioned adjacent the first seal layer to block the first gaps;

wherein each first seal segment is coupled to a single radially adjacent second seal segment by a spot weld, a rosette weld, a braze joint, or a flat-headed rivet and is coupled to a different second seal segment by a non-durable adhesive or a removable fastener, the different second seal segment and the single radially adjacent second seal segment being circumferentially adjacent; and wherein the first seal layer and the second seal layer define a substantially complete perimeter of a seal slot in which the first seal layer and the second seal layer are vertically installed.

2. The seal system of claim 1, wherein the intermediate portion defines a curved surface.

3. The seal system of claim 1, wherein the intermediate portion defines an angular corner.

4. The seal system of claim 1, wherein the plurality of first seal segments are disposed radially outward of the plurality of second seal segments.

5. The seal system of claim 4, wherein each second seal segment of the plurality of second seal segments has a straight profile.

6. The seal system of claim 4, wherein each first seal segment of the plurality of first seal segments has a straight profile.

7. The seal system of claim 1, wherein the second seal segments of the plurality of second seal segments have a uniform second height.

8. The seal system of claim 1, wherein each seal segment of the plurality of second seal segments is a straight seal segment; and wherein each straight seal segment is positioned radially inward of a respective one of the first gaps between adjacent pairs of the plurality of first seal segments.

9. The seal system of claim 1, wherein each seal segment of the plurality of second seal segments comprises a third leg, a fourth leg, and an intermediate portion between the third leg and the fourth leg; wherein each adjacent pair of seal segments of the plurality of second seal segments is separated by a second gap; and wherein the plurality of second seal segments also defines the substantially complete perimeter of the seal slot in which the first seal and the second seal are vertically installed.

10. The seal system of claim 9, wherein the first gaps between respective adjacent pairs of the plurality of first seal segments are circumferentially offset from the second gaps between respective adjacent pairs of the plurality of second seal segments.

11. A turbine vane comprising:

a metal spar comprising an airfoil-shaped body;

an outer side wall defining an opening through which the metal spar is installed;

a ceramic matrix composite (CMC) vane shell disposed over the airfoil-shaped body of the metal spar, the CMC vane shell having a radially outer vane platform and a radially inner vane platform; and an inner side wall joined to the ceramic matrix composite vane shell;

wherein a first seal system of claim 1 is disposed between the outer side wall and the radially outer vane platform, and a second seal system of claim 1 is disposed between the inner side wall and the radially inner vane platform;

and wherein each of the first seal system and the second seal system is vertically oriented within a respective platform seal slot and a respective side wall seal slot.

* * * * *